United States Patent [19]

Fontanet et al.

[11] 4,234,522

[45] Nov. 18, 1980

[54] VARIABLE DIFFUSER FOR CARBURETORS

[75] Inventors: Pierre Fontanet, Versailles; Georges Desjardins, Rueil-Malmaison, both of France

[73] Assignee: Regie Nationale des Usines Renault, Boulogne-Billancourt, France

[21] Appl. No.: 957,448

[22] Filed: Nov. 3, 1978

Related U.S. Application Data

[63] Continuation of Ser. No. 745,836, Nov. 30, 1976, abandoned.

[30] Foreign Application Priority Data

Dec. 3, 1975 [FR] France ..... 75 36951

[51] Int. Cl.[3] ..... F02M 9/12

[52] U.S. Cl. ..... 261/23 A; 261/62; 261/DIG. 39; 261/DIG. 78; 261/DIG. 56; 261/78 R; 261/44 D

[58] Field of Search ..... 261/DIG. 78, DIG. 56, 261/65, 23 A, 78 R, DIG. 39, 44 D; 123/119 EE, 141

[56] References Cited

U.S. PATENT DOCUMENTS

| | | | |
|---|---|---|---|
| 1,140,000 | 5/1915 | Rubesky | 261/DIG. 78 |
| 1,973,362 | 9/1934 | Weiertz et al. | 261/44 R |
| 2,084,340 | 6/1937 | Hartsough | 261/62 |
| 2,977,205 | 3/1961 | Austin | 123/141 |
| 3,143,401 | 8/1964 | Lambrecht | 261/DIG. 78 |
| 3,319,942 | 5/1967 | Mennesson | 261/23 A |
| 3,336,013 | 8/1967 | Salo | 261/62 |
| 3,523,680 | 8/1970 | Bartholomew | 261/DIG. 78 |
| 3,544,083 | 12/1970 | Currie | 261/DIG. 78 |
| 3,591,148 | 7/1971 | Schmitz | 261/62 |
| 3,778,038 | 12/1973 | Eversole et al. | 261/DIG. 78 |
| 3,814,389 | 5/1972 | August | 261/DIG. 78 |
| 3,885,004 | 5/1975 | Marsee | 261/23 A |
| 3,953,548 | 4/1976 | Knapp et al. | 261/DIG. 78 |
| 3,977,374 | 8/1976 | August | 123/141 |
| 3,998,612 | 12/1976 | Lundy | 261/DIG. 56 |
| 4,001,356 | 1/1977 | Graybill | 261/40 |
| 4,034,028 | 7/1977 | Ma | 261/44 R |
| 4,087,493 | 5/1978 | Petermann | 261/DIG. 78 |

FOREIGN PATENT DOCUMENTS

| | | | |
|---|---|---|---|
| 580090 | 10/1924 | France | 261/DIG. 56 |
| 154499 | 12/1920 | United Kingdom | 261/DIG. 56 |
| 495471 | 2/1937 | United Kingdom | 261/62 |

*Primary Examiner*—Tim R. Miles

*Attorney, Agent, or Firm*—Oblon, Fisher, Spivak, McClelland & Maier

[57] ABSTRACT

An improvement for internal combustion engine carburetors of the variable diffuser type with a sonic throat, the diffuser having a circular intake passage leading to an obstacle in the form of a body of revolution of maximum diameter appreciably larger than the intake passage, coaxial with the passage and axially adjustable to form, with a fixed divergent circular wall prolonging the intake passage of the carburetor barrel, a circular divergent sonic-flow nozzle, the annular throat of which is formed between the intake passage and the nearest surface of the adjustable obstacle.

2 Claims, 4 Drawing Figures

VARIABLE DIFFUSER FOR CARBURETORS

This is a continuation of application Ser. No. 745,836, filed Nov. 30, 1976, now abandoned.

BACKGROUND OF THE INVENTION

1. Field of the Invention

The present invention relates to carburetion and more particularly to the improvement of the qualities of atomization and the homogeneity of the mixture in a carburetor having a diffuser with a sonic throat through which the fuel mixture passes.

2. Description of the Prior Art

The atomization obtained with conventional carburetors with butterfly valves is not generally sufficient for perfect combustion and distribution, particularly at low speeds where the amount and the velocity of the intake air are too small to homogenize and disperse the fuel coming from the idle or main jets. Better atomization can be obtained using the so-called "Cannot shock" produced downstream of a throat with supersonic flow. This technique has been applied to a passage for the injection of the idle mixture, where the slow flow and the vacuum of the main intake have allowed the realization of the idle atomizer in a sonic-flow throat. Also known is a variable section nozzle obtained by transverse sliding of a gate or shell. Technological difficulties and mechanical friction reduce their utilization, however, particularly at low flows, where they infer-fere with the smooth and continuous functioning of the controls and constitute the source of numerous instabilities.

SUMMARY OF THE INVENTION

An object of the present invention is to provide a sonic flow regime in a simple manner by means of a variable-section nozzle in the main intake passage of the carburetor without the drawbacks of the known systems, utilizing the principle of a plane or conical diffuser in which the variation in cross section of the gas flow is essentially due to the variation of the radius of this section. The control of the minimum section at the throat is obtained by simple linear motion of a movable piece, or obstacle, in the form of a plate or ogive, parallel to the general direction of the flow. The position of this movable piece is adjusted to obtain a velocity at the throat which is always sonic, that resultant supply of air being governed only by the minimum section and the upstream air pressure, which could be modified by vaning with the help of a butterfly valve, for example.

The variation in throat section can be as finely controlled as desired with suitable design of the movable ogive or plate. The divergence, which is then very progressive in cross section, permits a supersonic flow (velocity of flow greater than the speed of sound), followed by a very strong recompression shock at the moment when the flow, slowing after its initial supersonic acceleration, returns to the normal conditions of subsonic flow. The gentle variation of the section downstream of the throat permits arbitrary extension of the supersonic region and makes the best use of the recompression shock, to improve the homogenity of the air-fuel mixture.

This sonic diffuser may be used alone as the main diffuser of the carburetor or in parallel with a conventional arrangement in order to palliate its poor operation in the range of low flows only. It may be, then, only an accessory element of a conventional carburetor or a veritable main barrel of the carburetor.

More particularly, the sonic-flow, variable-section diffuser for internal combustion engines of the invention is characterized by the fact that its circular intake passage opens onto an obstacle in the form of a body of revolution and of maximum diameter sensibly greater than that of the intake passage, coaxial with the passage adjustable in position along its axis and forming with the fixed divergent circular wall, prolonging the intake passage of the carburetor barrel, a sonic-flow, circular, divergent nozzle, the circular throat of which is formed between the exit periphery of the passage and the closest portion of the obstacle's surface.

This obstacle, in the form of a body or revolution, may have a plane circular surface oriented perpendicular to the axis of the intake passage, facing the passage, the fixed circular wall of the carburetor opposed to the surface diverging slightly with respect thereto.

According to a preferred embodiment, the obstacle, in the form of a body of revolution, would be an ogive with a conical surface pointed toward the intake passage, the fixed circular wall of the carburetor prolonging the passage and forming a conical diverging surface, realizing an increasing flow-section nozzle with the opposed conical surface of the obstacle.

Adjustment of the axial position of the obstacle would conveniently be provided by the accelerator linkage of the carburetor.

The zone of the sonic flow in the nozzle could be heated by means of electrical resistors situated inside the adjustable obstacle and/or by circulating water in the carburetor body near the nozzle wall.

In a carburetor with a variable-section, sonic-flow diffuser conforming to the invention, the diffuser is located in a flow passage by-passing the venturi and throttle of the carburetor and receives a secondary flow of fuel upstream of the nozzle's sonic throat. In a variant of this embodiment, the intake passage would constitute the first barrel of a two-barrel carburetor, the intake flow of which is controlled by axial adjustment of the diffuser obstacle by means of an axial control rod through the air filter.

The obstacle would advantageously have on its circular divergent surface forming the nozzle wall radial grooves of increasing cross section to maintain a minimum sonic intake flow when the obstacle, drawn by the control rod, comes up against the carburetor wall, closing the nozzle throat.

In the case of automobile engines, calculation shows that this arrangement will be compact (ogive or plate obstacles of only a few centimeters in diameter) and that this movable part will be aspirated towards the sonic throat by a force of only some 20 to 30 newtons. This is not much force, especially in view of the small usable displacement (of the order of a few millimeters) and the mechanical advantage necessary between the accelerator pedal and diffuser to provide position adjustment of the latter by the same control as that of the conventional throttle.

The conical form of diffuser is considered as the preferable mode of realization by reason of both the flow and the ease of control (larger usable displacement).

Such a carburetor configuration improves the atomization of the mixture and causes preliminary evaporation of the fuel in the recompression shock. The result is greater homogeneity of the mixture and better distribution of it among the cylinders, together with an increase in the rate of combustion with a corresponding reduction of irregularities in motor performance.

Another result is the possibility of operating with leaner mixtures and thus of lowering fuel consumption.

In general, the space available for incorporating this arrangement in a carburetor will be small and will not permit sufficiently gradual divergence to assure large intake flows without pressure losses. Sonic-throat carburetors, then, are not suited to heavy-duty applications. Use of sonic throats is most advantageous in low-charge applications. The high charging at top speed, or during acceleration, could be effected by a conventional arrangement, e.g. a butterfly valve, or by the diffuser itself (plain or sonic), but not operating then at sonic flow, or by the combination of a diffuser with a sonic throat acting as the first barrel of a two-barrel carburetor.

BRIEF DESCRIPTION OF THE DRAWINGS

Various other objects, features and attendant advantages of the present invention will be more fully appreciated from the following detailed description when considered in connnection with the accompanying drawings, wherein like reference numerals designate like or corresponding parts, and in which.

DETAILED DESCRIPTION OF THE ILLUSTRATED EMBODIMENTS

Figure 1:
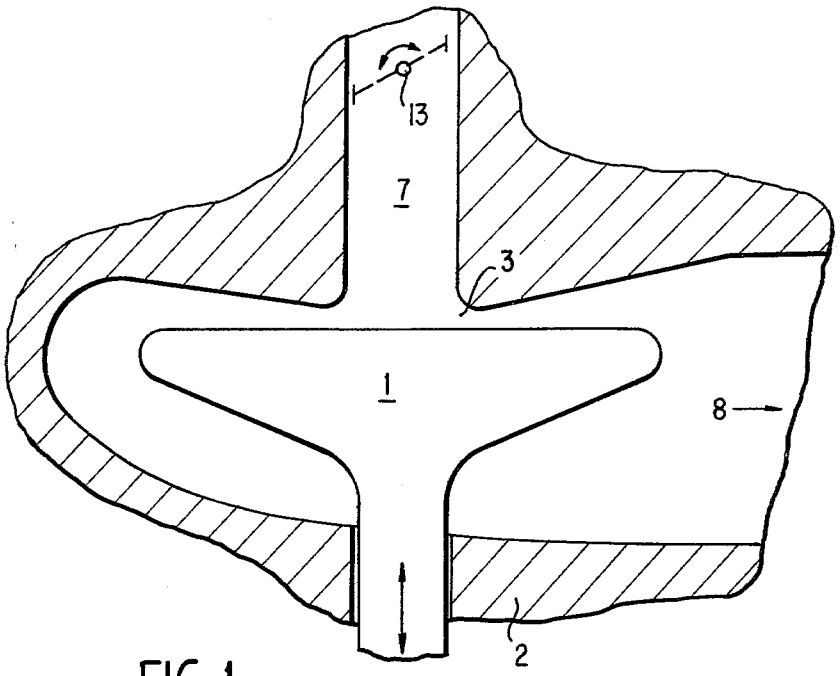
FIG. 1 shows schematically and partly, in cross-section, a flat sonic-flow diffuser.

Referring now to the drawings, and more particularly to

Figure 2:
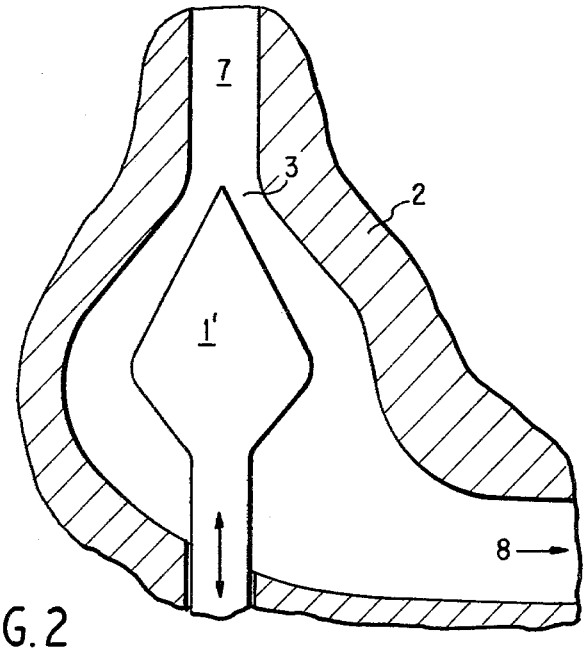
FIG. 2 represents a preferred embodiment having a conical diffuser.

FIGS. 1 and 2 where there is shown in axial cross section, the details of the flow profiles of flat and conical diffusers, respectively, air enters at an inlet and exits toward an intake manifold of a motor. The movable parts 1 and 1' of the diffuser slide with respect to the body of a carburetor 2 so as to vary the width of the sonic throat 3 to give the desired adjustment.

Figure 3:
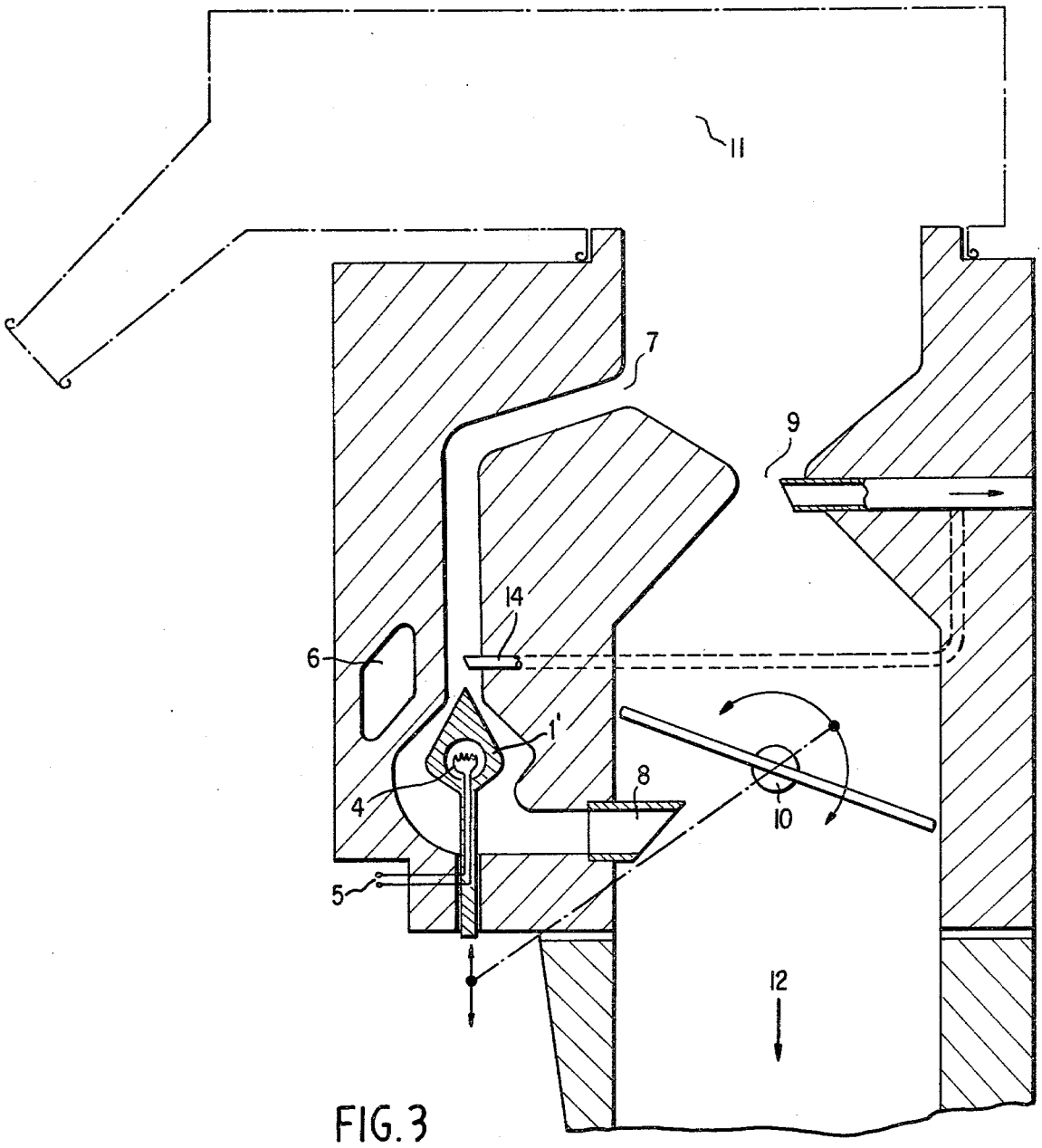
FIG. 3 illustrates an example of application of the embodiment shown in FIG. 2 to low-charge regimes of a carburetor.

Turning now to FIG. 3, which shows an application of the preferred embodiment.

A conical diffuser 1' of the type described above in FIG. 2 is connected in parallel with the throat 9 of a conventional carburetor by the inlet passage 7 and possibly may be heated by internal electrical resistances. The movement of the conical diffuser 1' is governed by the control for opening the main butterfly 10. The conical diffuser 1' obtains air from passage 7 coming from an air filter 11. The fuel arrives by a secondary feed line 14 and the air-fuel mixture formed immediately downstream of the sonic diffuser 1' is ejected after having traversed this diffuser at intake 8 of the manifold 12 towards the motor, downstream of the butterfly. The diffuser thus forms only the mixtures for low intakes, while full loads are taken care of by the main carburetor, when the large flows and high flow velocities make the mixing problems less delicate.

Figure 4:
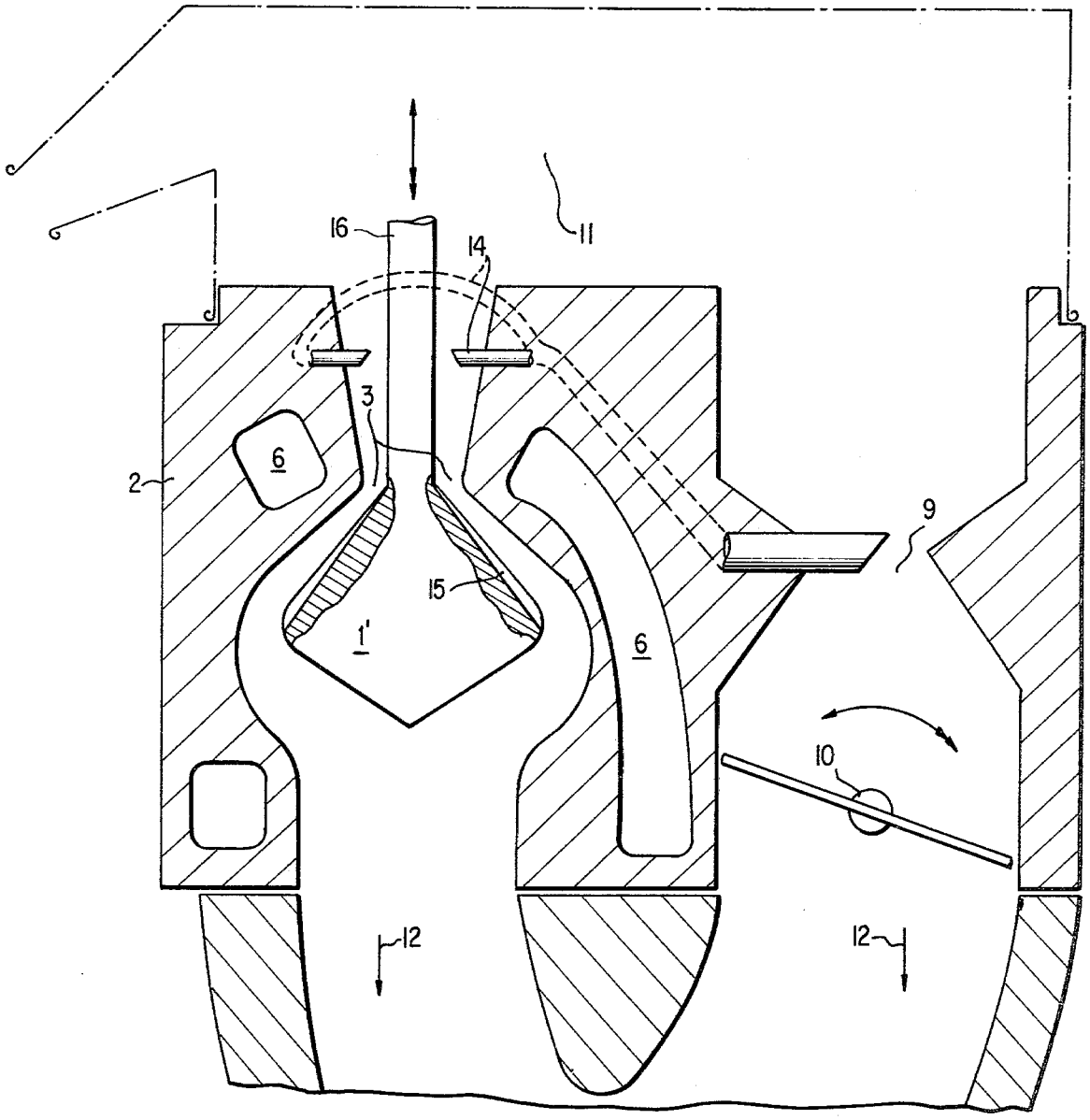
FIG. 4 shows the application of the preferred embodiment to the first barrel of a two-barrel carburetor.

FIG. 4 shows a two-barrel carburetor configuration in which the first barrel employs a sonic diffuser 1' of the conical type being controlled by an axial rod 16. The ogive may have grooves 15 for metering a minimum air flow when in a closed position against the mating surface of the carburetor body 2 at throat 3.

The fuel input may be upstream of the throat 3 since there the simple Bernoulli relation between pressure and flow is not yet perturbed by the sonic flow. The fuel may be additionally modulated by an obturating device or a needle integral with the sonic throat control 16.

This sonic-throat arrangement is compatible with the conventional fuel supplies of the "constant-level reservoir" type and/or with injection systems.

The configuration with grooves 15 allows control of the minimum air flow when the diffuser is up against its seat, thus functioning at idle.

One can complete this arrangement with a heating system, as indicated in FIG. 3 to avoid icing at the throat 3, where the temperature will be much lower than ambient, given the initial gas expansion produced there. One may also utilize a water passage 6 in the body of the carburetor 2 or the electrical heating of a resistance element 4 located inside the adjustable plate or ogive by way of the leads 5, as shown in FIG. 3.

Control of the movement of the plate 1 or ogive 1' can be from downstream as shown in FIGS. 1, 2 and 3, or from upstream as shown in FIG. 4. This latter arrangement avoids sealing problems since only air is present in this direction. As in FIG. 3, a line 14 brings in the fuel upstream of the sonic throat 3 into the air flow coming from the air filter 11.

Obviously, many modifications and variations of the present invention are possible in light of the above teachings. It is therefore to be understood that within the scope of the appended claims, the invention may be practiced otherwise than as specifically described herein.

We claim:

1. In a carburetor body of an internal combustion engine, a variable section, sonic flow diffuser, comprising:

means for defining a circular intake passage in the carburetor body and a circular, fixed, divergent wall into which said circular intake passage opens;

an obstacle in the form of a body of revolution and of a maximum diameter greater than that of said intake passage being disposed in said carburetor body in said circular, fixed, divergent wall, coaxial with said divergent wall and said intake passage;

means for adjusting the position of said obstacle along the axial path of said intake passage and said circular divergent wall;

such that a sonic flow, circular, divergent nozzle is formed, the annular throat of which is formed between the exit periphery of said intake passage and the nearest portion of the surface of said obstacle, and the variation in the gas flow cross-section of which is due to the variation of the radius of such section with respect to the flow axis wherein said obstacle has a plane circular surface oriented perpendicular to the axis of said intake passage, facing said passage, the fixed circular wall of said carburetor opposite said surface diverging slightly with respect thereto and wherein said intake passage forms the first barrel of a two-barrel carburetor, the air flow of which is controlled by the axial adjustment of said obstacle, said means for adjusting the position of said obstacle comprising an axial control rod extending through the air filter of said carburetor for axially adjusting said obstacle.

2. In a carburetor body of an internal combustion engine, a variable section, sonic flow diffuser, comprising:

means for defining a circular intake passage in the carburetor body and a circular, fixed, divergent wall into which said circular intake passage opens;

an obstacle in the form of a body of revolution and of a maximum diameter greater than that of said intake passage being disposed in said carburetor body in said circular, fixed, divergent wall, coaxial with said divergent wall and said intake passage;

means for adjusting the position of said obstacle along the axial path of said intake passage and said circular divergent wall;

such that a sonic flow, circular, divergent nozzle is formed, the annular throat of which is formed between the exit periphery of said intake passage and the nearest portion of the surface of said obstacle, and the variation in the gas flow cross-section of which is due to the variation of the radius of such section with respect to the flow axis, the fixed ciruclar wall of said carburetor opposite said surface diverging slightly with respect thereto and wherein said intake passage forms the first barrel of a two-barrel carburetor, the air flow of which is controlled by the axial adjustment of said obstacle, said means for adjusting the position of said obstacle comprising an axial control rod extending through the air filter of said carburetor for axially adjusting said obstacle wherein said obstacle has radial grooves of increasing flow section disposed on its circular diverging surface forming a wall of said nozzle, allowing a minimum sonic intake flow to be maintained even when said obstacle is drawn by said control rod up against the wall of said carburetor to thereby close said nozzle throat.

* * * * *